United States Patent [19]

Makurof

[11] Patent Number: 4,951,184

[45] Date of Patent: Aug. 21, 1990

[54] DECK LIGHTING FIXTURE

[76] Inventor: Daniel S. Makurof, 34615 Koch Ave., Sterling Heights, Mich. 48310

[21] Appl. No.: 316,466

[22] Filed: Feb. 27, 1989

[51] Int. Cl.[5] ..... F21R 1/02

[52] U.S. Cl. ..... 362/362; 362/147; 362/368; 362/432

[58] Field of Search ..... 362/147, 362, 368, 432

[56] References Cited

U.S. PATENT DOCUMENTS

| | | | |
|---|---|---|---|
| 2,092,989 | 9/1937 | Sorensen | 362/432 |
| 2,908,808 | 10/1959 | Kester | 362/363 |
| 3,389,246 | 6/1968 | Shemitz | 362/362 |
| 4,394,718 | 7/1983 | Balzer | 362/368 |

FOREIGN PATENT DOCUMENTS

| | | | |
|---|---|---|---|
| 3017443 | 11/1981 | Fed. Rep. of Germany | 362/362 |
| 66790 | 2/1929 | Sweden | 362/147 |
| 17066 | of 1907 | United Kingdom | 362/362 |

*Primary Examiner*—Douglas Hart
*Attorney, Agent, or Firm*—Peter D. Keefe

[57] ABSTRACT

A lighting fixture for providing security, safety and beauty which is constructed of an all wooden structure with a plastic lens which complementarily fits onto the wooden structure. The all wooden structure is preferred to be provided from a single block of wood that is of a type selected to match that of the proposed wooden structure environment of use. The block of wood is worked so that it acquires a central cavity in which only a base portion connects each remaining end of the block on either side of the central cavity. The ends of the block are cut to provide a fanciful appearance. A hole is made in the base portion, through which is inserted a lamp socket. The lamp socket is then secured to the hole. The electrical wire from the socket leaves the base portion from the exterior side. A light bulb is then removably placed into the socket. A translucent lens is then placed over the cavity, the lens following and complementing the exterior contour of the wood block. A wooden baseboard and wooden spacer may be included to add to the harmonious appearance of the lighting fixture with respect to the wooden structure to which it is to be attached.

22 Claims, 1 Drawing Sheet

DECK LIGHTING FIXTURE

BACKGROUND OF THE INVENTION

1. Field of the Invention

The present invention relates to lighting fixtures, and more particularly to a lighting fixture, made of wooden structural components, that is most propitiously intended to be used in harmonious conjunction with wooden structures, such as siding and decking.

2. Description of the Prior Art

The use of wooden structural materials in construction has recently gained a renaissance in that rot resistant lumber, such as pressure treated pine, red wood and cedar, have become widely available and commercially attractive to builders. In an age of plastics and aluminum, the good looks and warm appearance of rot resistant lumber products have become a selling point for quality construction in the facades of houses and garages, as well as decking.

There has long been recognized a definite need to provide adequate lighting around dwellings and other structures in order to dissuade the criminal elements of society and to provide illumination in areas where traversal involves potential issues of safety, particularly in the vicinity of steps. Thus, the public has increasingly shown an interest in providing lighting so as to minimize risk from theft, damage and accident.

In the last several years there has come to be recognized the fact that imaginative and well planned lighting can enhance the appearance of homes, both in terms of the house itself and the landscaping around the house. To this end, a class of lighting fixtures has become commercially available which utilizes a low voltage, typically 12 volts D.C., so that the lighting fixtures may be safely placed in areas of moisture and potential contact with children and pets. Typically, these lighting fixtures are constructed of a plastic or aluminum shell and are either secured to a wall or are anchored into the soil around sidewalks and shrubbery.

With the foregoing developments occurring simultaneously, there has been created a need to merge lighting for safety, security and beauty with the wooden construction materials that are becoming increasingly more popular.

In the prior art, lighting fixtures have been devised in which the lighting fixture has attached to it at least one piece of wood so that the lighting fixture blends with greater harmony with the wooden structure to which it is to be attached. An example of such lighting fixtures are those manufactured by one Minneapolis, Minn. manufacturer. These lighting fixtures have a central plastic lens to which is attached at either end a block of solid wood. While it is the case that the wooden ends of the lighting fixture may match the wooden structure to which the lighting fixture is intended to be attached, the fact is that the lighting fixture remains substantially a plastic device with wooden trappings. Consequently, the warmth of a wooden structure is offended by the substantially plastic appearance of these lighting fixtures in spite of the wooden end treatments.

Consequently, what is needed is a lighting fixture which is clearly wooden in structure, with only a plastic lens component. Thusly, such a lighting fixture, rather than appearing plastic with wooden trim, appears wooden with plastic trim. Such a structure for a lighting fixture would solve the problem of providing a lighting fixture for security, safety and beauty purposes while being in full harmony with wooden construction materials.

SUMMARY OF THE INVENTION

The present invention is a lighting fixture for providing security, safety and beauty which is constructed of an all wooden structure with a plastic lens which complementarily fits onto the wooden structure.

The all wooden structure of the lighting fixture according to the present invention is preferred to be provided from a single block of wood that is of a type selected to match that of the proposed wooden structure environment of use. The block of wood is worked so that it acquires a central cavity in which only a base portion connects each remaining end of the block on either side of the central cavity. The ends of the block are cut to provide a fanciful appearance. A hole is made in the base portion, through which is inserted a lamp socket. The lamp socket is then secured to the hole by either a press fit of other means, such as clamping. The electrical wire from the socket leaves the base portion from the exterior side. A light bulb is then removably placed into the socket. A translucent lens, preferably of plastic, is then placed over the cavity, the lens following and complementing the exterior contour of the wood block.

Further, it is possible to add an optional wooden baseboard and wooden spacer to add to the harmonious appearance of the lighting fixture according to the present invention with respect to the wooden structure to which it is attached.

Accordingly, it is an object of the present invention to provide a single unit wooden lighting fixture, having only a complementary lens, which strikes the eye as being primarily wooden in structure.

It is a further object of the present invention to provide a lighting fixture which fully integrates the uses therefor of safety, security and beauty, while at the same time fully harmoniously integrating with a wooden structure to which it is to be attached.

These, and additional objects, advantages, features and benefits of the present invention will become apparent from the following specification.

DETAILED DESCRIPTION OF THE PREFERRED EMBODIMENT

Figure 1:
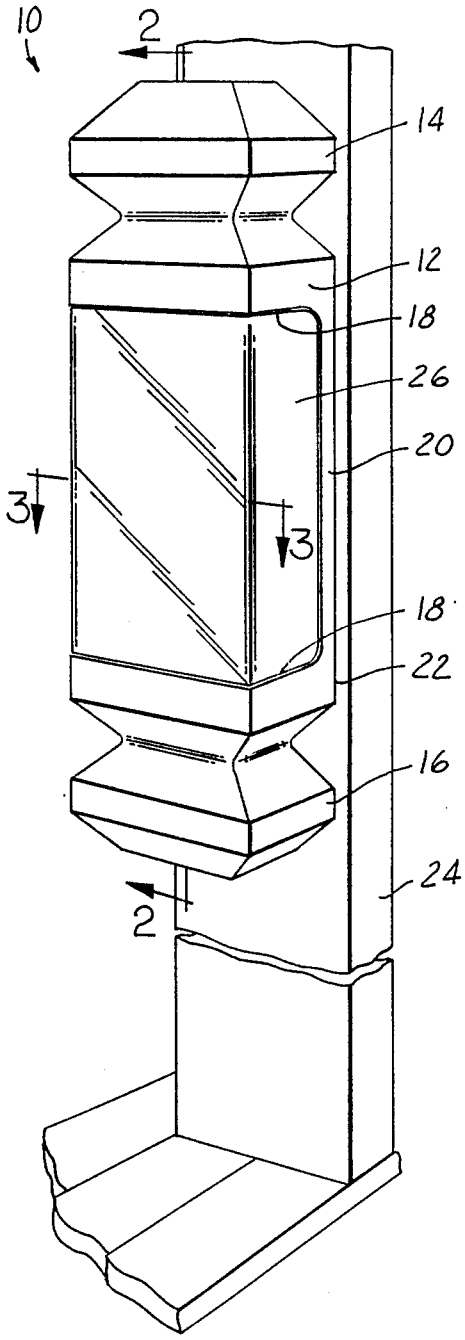
FIG. 1 is a perspective view of the lighting fixture according to the present invention, shown attached to a wooden structure.

Referring now to the drawing, FIG. 1 shows the wooden lighting fixture 10 according to the present invention in a typical environment of use. The wooden lighting fixture 10 is composed of a singular wooden piece 12, preferably formed from a single block of wood, but it is possible to glue or otherwise connect together a plurality of wooden pieces in order to form the singular wooden piece 12. It is also possible to construct the singular wooden piece 12 out of simulated wood materials. Each end 14 and 16 of the singular wooden piece 12 are fancifully cut as desired for a particular end use. A central cavity 18 is located between the ends 14 and 16, the central cavity forming a base portion 20 in the singular wooden piece 12, between the ends thereof. The rear side 22 of the base portion is utilized as a mounting surface for connection to an external structure, typically a wooden post 24 or other erect wooden structure. A translucent lens 26 is removably connected with the singular wooden piece 12, the translucent lens being structured to follow the contour of the external surface dimensions of the singular wooden block in the vicinity of the central cavity.

Figure 2:
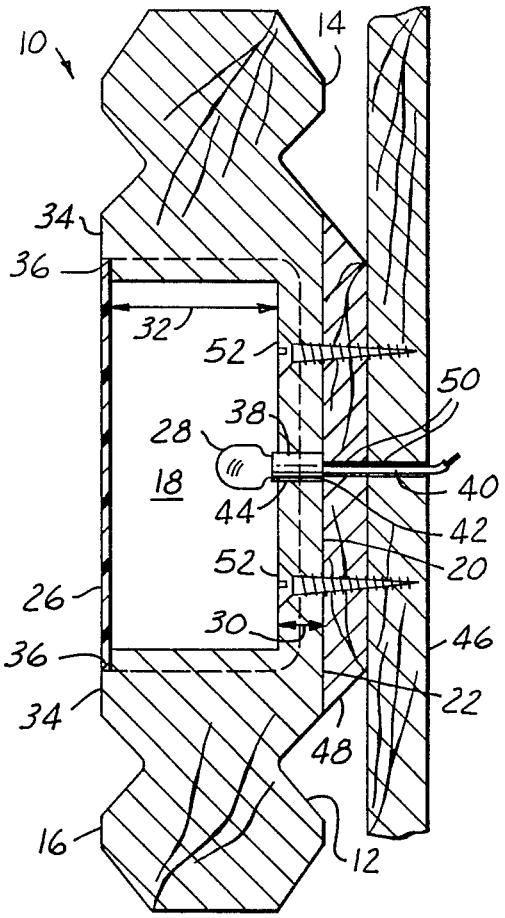
FIG. 2 is a part sectional side view of the lighting fixture according to the present invention, as seen along lines 2—2 in FIG. 1, showing also a baseboard and spacer.
Figure 3:
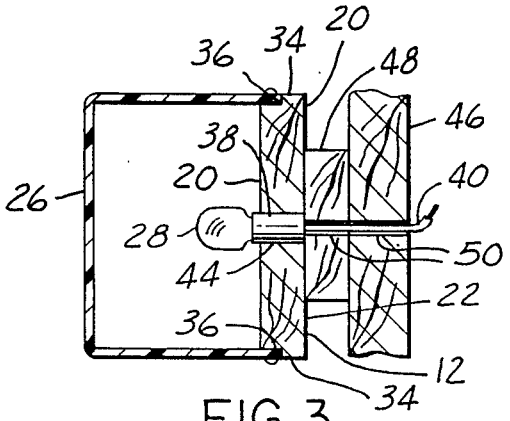
FIG. 3 is a part sectional plan view of the lighting fixture according to the present invention, seen along lines 3—3 in FIG. 1.

FIGS. 2 and 3 show the construction and generally assembly features of the wooden lighting fixture 10. The singular wooden piece 12 is continuous between each end 14 and 16. Between each end is located the central cavity 18, the length of which between the ends is determined by over-all proportions of the wooden lighting fixture 10, as well as the size of area of illumination that is desired. The latter consideration is based upon the fact that the source of illumination, which is a light bulb 28, is housed within the central cavity, so that the area of illumination depends directly on the size of the central cavity 18. The thickness 30 of the base portion 20 is substantially determined by the structural strength needed by the wooden lighting fixture 10. It is preferred that the thickness 30 of the base portion be considerably less than the depth 32 of the central cavity. Around the perimeter of the central cavity 18 it is preferred to indent the surface 34 in order to form a recess 36 of a thickness equal to that of the translucent lens 26. In this manner, the translucent lens may be fitted over the central cavity and, along its edges, slip into the recess, thereby providing a contoured fit with the surface 34 of the singular wooden piece. It is preferred that the translucent lens be removably connected with the singular wooden piece 12 by a plurality of brass screws, although other means, such as a snap fit are possible. The translucent lens is preferred to be constructed of plastic, but can be made of other materials, such as frosted glass.

The illumination system of the wooden lighting fixture 10 is provided by a bulb socket 38, the light bulb 28, and electrical wiring 40, which exits from the bottom 42 of the bulb socket. A hole 44 is provided in the base portion 20, preferably in a mid-point location of the central cavity 18. The bulb socket 38 non-electrical socket structure is preferred to be of a non-corrosive material, such as plastic or ceramic, and the type of socket is preferred to be of of the kind adapted for use with all wedge base lamps, the light bulb being preferred of this all wedge base lamp type. It is further preferred that the illumination system used in the wooden lighting fixture 10, be preselected to handle either low voltage, such as 12 volts D.C., or conventional 110 volts A.C. The bulb socket 38 is preferred to fit snuggly in the hole, and may be secured thereto by a press fit, glue, clamping or other means. A light reflector may be provided adjacent the bulb socket 38 in order to aid the lighting efficiency of the wooden lighting fixture 10, as well as limiting the operating temperature due to bulb heating.

In the event it is desired to enhance the appearance of the wooden lighting fixture 10 in relation to an external wooden structure to which it is to be attached, a baseboard 46 and spacer 48 may be added. Typically, the baseboard is a flat, generally rectangular wooden board and the spacer is a thin wooden board which is beveled at each end to match the contours of the ends 14 and 16, respectively. A wiring hole 50 is provided in each of the spacer 48 and baseboard 46 so that the wiring 40 from the bulb socket 38 may pass therethrough to an electrical source (not shown). It is preferred to connect the wooden lighting fixture 10 to the spacer 48 and the baseboard 46 by woodscrews 52. Alternatively, when the spacer and baseboard are not involved with the wooden lighting fixture 10, the woodscrews 52 may be used for mounting the wooden lighting fixture 10 directly onto a wooden structure, such as the wooden post 24. It is preferred to use non-corrosive woodscrews, such as those made of brass.

In operation, the ends 14 and 16 are cut on the singular wooden piece 12 to form a fanciful geometry. The central cavity 18 is formed by cutting and the recess 36 is formed by routing. The hole 44 is bored in the base portion 20. The bulb socket is placed through the hole, with the wiring 40 exiting the rear side 22 of the base portion. A light bulb 28 is placed in the bulb socket. If the wooden lighting fixture 10 is to be used without the spacer 48 and baseboard 46, then the wooden lighting fixture 10 is secured to a wooden (or other) surface by screws 52 (or other fastening devices, such as bolts). In the event the wooden lighting fixture 10 is to be used with the spacer and baseboard, then the spacer and baseboard are bored to provide the holes 50, the wiring 40 is threaded therethrough, and they are then attached to the wooden lighting fixture 10 by the screws 52. The baseboard is then attached to an external structure, such as a post, by conventional fastening means. Finally, the translucent lens 26 is placed over the central cavity so that its edges fit into the peripheral recess and the translucent lens is then releasably connected with the singular wooden piece 12 by brass woodscrews.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A lighting fixture, comprising:

a wooden piece, said wooden piece having a central cavity, said central cavity forming a base portion, said wooden piece having an end on either side of said central cavity;

illumination means within said central cavity of said wooden piece; and a translucent lens releasably covering said central cavity of said wooden piece.

2. The lighting fixture of claim 1, wherein said wooden piece has a surface having a surface contour on each of said ends, said surface being located adjacent said central cavity; further wherein said central cavity has a perimeter which includes a recess for receiving said translucent lens so that said translucent lens follows said surface contour of said surface.

3. The lighting fixture of claim 2, wherein said base portion has a width; further wherein said central cavity has a depth substantially greater than said width of said base portion.

4. The lighting fixture of claim 3, wherein said illumination means comprises:

a bulb socket connected with said base portion;

a light bulb releasably connected with said bulb socket; and wiring connected with said bulb socket for connection with an external source of electricity.

5. The lighting fixture of claim 4, wherein said light bulb is of an all wedge base type.

6. The lighting fixture of claim 4, wherein said base portion has a hole for receiving said bulb socket and for exiting said wiring from said base portion.

7. The lighting fixture of claim 6, further comprising a baseboard connected with each said end of said wooden piece, said baseboard forming said base portion.

8. The lighting fixture of claim 6, wherein said wooden piece is formed of a single wooden block.

9. The lighting fixture of claim 6, further comprising a spacer adjacent said base portion; and a baseboard adjacent said spacer, both of said spacer and said baseboard having a hole for passing therethrough said wiring.

10. A lighting fixture, comprising:

a wooden piece formed of a single block of wood, said wooden piece having a central cavity, said central cavity forming a base portion, said wooden piece having an end on either side of said central cavity, said wooden piece having a surface contour on each of said ends, said surface being located adjacent said central cavity;

illumination means within said central cavity of said wooden piece, said illumination means comprising:

a bulb socket connected with said base portion;

a light bulb releasably connected with said bulb socket; and wiring connected with said bulb socket for connection with an external source of electricity; and a translucent lens releasably covering said central cavity of said wooden piece; said central cavity having a perimeter which includes a recess for receiving said translucent lens so that said translucent lens follows said surface contour of said surface.

11. The lighting fixture of claim 10, wherein said base portion has a width; further wherein said central cavity has a depth substantially greater than said width of said base portion.

12. The lighting fixture of claim 11, wherein said base portion has a hole for receiving said bulb socket and for exiting said wiring from said base portion.

13. The lighting fixture of claim 12, wherein said light bulb is of an all wedge base type.

14. The lighting fixture of claim 12, further comprising a baseboard connected with each said end of said wooden piece, said baseboard forming said base portion.

15. The lighting fixture of claim 12, further comprising a spacer adjacent said base portion; and a baseboard adjacent said spacer, both of said spacer and said baseboard having a hole for passing therethrough said wiring.

16. A lighting fixture, comprising:

a simulated wooden piece formed of a simulated wood material, said simulated wooden piece having a central cavity, said central cavity forming a base portion, said simulated wooden piece having an end on either side of said central cavity, said simulated wooden piece having a surface contour on each of said ends, said surface being located adjacent said central cavity;

illumination means within said central cavity of said simulated wooden piece, said illumination means comprising:

a bulb socket connected with said base portion;

a light bulb releasably connected with said bulb socket; and wiring connected with said bulb socket for connection with an external source of electricity; and a translucent lens releasably covering said central cavity of said simulated wooden piece; said central cavity having a perimeter which includes a recess for receiving said translucent lens so that said translucent lens follows said surface contour of said surface.

17. The lighting fixture of claim 16, wherein said base portion has a width; further wherein said central cavity has a depth substantially greater then said width of said base portion.

18. The lighting fixture of claim 17, wherein said base portion has a hole for receiving said bulb socket and for exiting said wiring from said base portion.

19. The lighting fixture of claim 18, wherein said light bulb is of an all wedge base type.

20. The lighting fixture of claim 18, further comprising a baseboard connected with each said end of said simulated wooden piece, said baseboard forming said base portion.

21. The lighting fixture of claim 18, further comprising a spacer adjacent said base portion; and a baseboard adjacent said spacer, both of said spacer and said baseboard having a hole for passing therethrough said wiring.

22. The lighting fixture of claim 18, wherein said simulated wooden piece is constructed of a single block of simulated wood material.

* * * * *